US005465528A

United States Patent [19]

Schinzel et al.

[11] Patent Number: 5,465,528

[45] Date of Patent: Nov. 14, 1995

[54] CABINET WITH OVERLAPPING DOORS

[75] Inventors: Craig E. Schinzel, Ramsey; Robert G. Lau, Anoka, both of Minn.

[73] Assignee: Federal-Hoffman, Inc., Anoka, Minn.

[21] Appl. No.: 197,164

[22] Filed: Feb. 16, 1994

[51] Int. Cl.[6] ..... E06B 7/16

[52] U.S. Cl. ..... 49/368

[58] Field of Search ..... 49/367, 368, 473, 49/483.1, 499.1, 475.1

[56] References Cited

U.S. PATENT DOCUMENTS

| | | | |
|---|---|---|---|
| 3,299,574 | 1/1967 | Alexeff et al. | 49/483.1 X |
| 3,371,445 | 3/1968 | Herr et al. | 49/368 |
| 4,601,245 | 7/1986 | Kleykamp | 49/475.1 X |
| 5,216,840 | 6/1993 | Andrews | 49/368 X |

FOREIGN PATENT DOCUMENTS

| | | | |
|---|---|---|---|
| 658663 | 2/1963 | Canada . | |
| 1182828 | 6/1959 | France | 49/368 |

*Primary Examiner*—Peter M. Cuomo
*Assistant Examiner*—Jerry Redman
*Attorney, Agent, or Firm*—Merchant, Gould, Smith, Edell, Welter & Schmidt

[57] ABSTRACT

A cabinet has overlapping doors to cover a cabinet opening. The overlapping doors include sealing gaskets formed on interior surfaces of the doors. The doors are shaped for the gaskets of the doors to overlap and abut in sealing engagement upon closure of the doors.

4 Claims, 11 Drawing Sheets

CABINET WITH OVERLAPPING DOORS

I. BACKGROUND OF THE INVENTION

1. Field of the Invention

This invention pertains to a cabinet. More particularly, this invention pertains to a cabinet having overlapping doors with means to provide a dust and water tight seal upon closure of the doors.

2. Description of the Prior Art

The use of cabinets in industrial applications for housing electrical components and the like is quite common. In order to protect the housed components, the cabinets must seal the interior of the cabinet from external contaminants (for example, water and dust). Also, such cabinets may be used in outdoor applications where the probability of contamination of the interior increases. The industry has developed recognized standards for dust and water seal cabinets (for example, NEMA standards Type 4 and 12).

For housing electrical components, it is desirable to have a large access opening to the cabinet interior. The larger the opening, the larger the components which may be stored within the cabinet.

For cabinets with large openings, a hinged door becomes quite heavy and presents the possibility of damaging its hinges. Therefore, for large openings, dual doors are provided to cover the opening with each of the doors separately hinged.

In order to seal dual door cabinets, a support bar is commonly provided within the interior of the cabinet. The bar extends vertically down the center of the cabinet. When both doors were pivoted to the closed position, the free edge of the doors (i.e., the edges opposite the hinges) butt up and seal against the central support bar of the cabinet. Unfortunately, the presence of a central support bar restricts the size of components which can be placed within the interior of the cabinet since the central support bar is an obstruction to insertion of components into the cabinet interior.

Prior art cabinets have eliminated the central support bar and, instead, have provided overlapping doors. In overlapping dual doors, when the doors are in the closed position, an interior face of one door faces and abuts an exterior face of the other door in overlying relation. In order to provide a seal, a gasket or other sealing member would be provided on the opposing areas of each door to have a gasket-to-gasket seal. However, with respect to at least one of the doors, this would require a gasket on both the interior and exterior surfaces of the door. Such an arrangement adds to the complexity and cost of a cabinet door. Also, such prior art doors frequently do not provide adequate sealing of dust and water from the cabinet interior.

II. SUMMARY OF THE INVENTION

According to a preferred embodiment of the present invention, a cabinet having overlapping doors includes first and second door panels which overlap in a predetermined area. In the area of overlap, an interior surface of one of said doors has a raised ridge which opposes an interior surface of the other of said doors. The other of said doors has a resilient seal member provided on an interior surface thereof to oppose the raised edge of the first door. Upon closure of the door, the raised edge deforms the seal to embed the edge within the seal in sealing engagement. Additional aspects of the present invention include peripheral seals on interior surfaces of the doors which on closure of the doors causes the resilient sealing member of at least one of said doors to protrude beyond the perimeter of the door and engage a sealing member of the other door in sealing engagement.

III. BRIEF DESCRIPTION OF THE DRAWINGS

IV. DESCRIPTION OF THE PREFERRED EMBODIMENT

Figure 1:
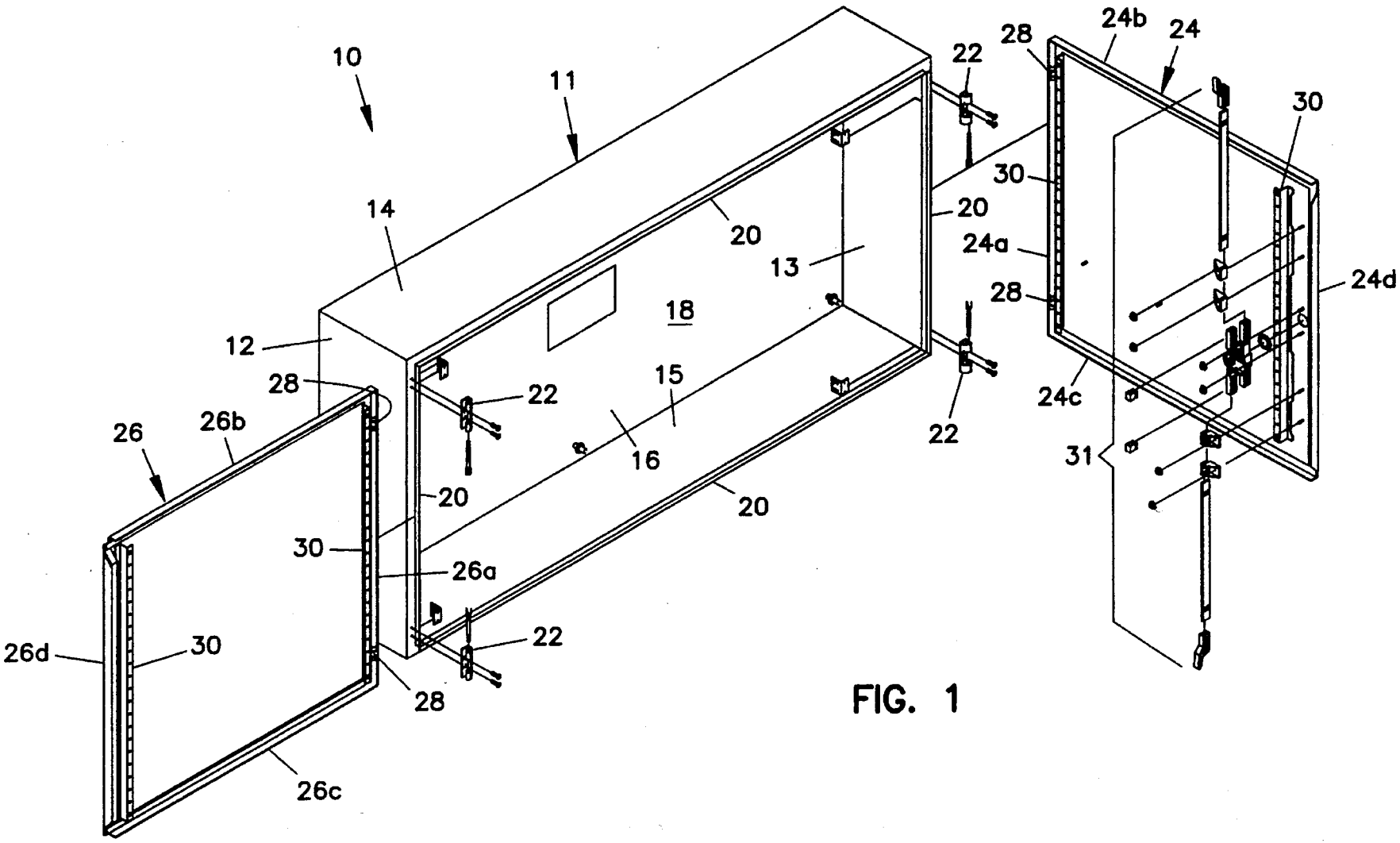
FIG. 1 is an exploded perspective view of a cabinet incorporating the novel door arrangement of the present invention.

Referring now to several drawing figures in which identical elements are numbered identically throughout, a description of the preferred embodiment of the present invention will now be provided. With initial reference to FIG. 1, the present invention pertains to a cabinet 10 which has a box-like shell 11, side walls 12, 13, top wall 14 and bottom wall 15 all connected by a back wall 16. The walls 12–16 cooperate to define a cabinet interior 18 into which electronic components and the like may be housed. Protruding outwardly from each of walls 12–15 is a continuous protruding edge 20 which completely surrounds the perimeter of the cabinet 10 to define an opening to interior 18.

It will be noted that no central support is provided extending between walls 15, 14.

Secured to each of walls 12, 13 are first hinge members 22. The hinge members 22 define pivot axes which extend parallel to each of side walls 12, 13.

Cabinet 10 further includes a first door panel 24 and a second door panel 26. Each of door panels 24, 26 are generally planar in construction with the surface area of each of door panels 24, 26 equal to approximately half of the surface area of the opening to interior 18.

Each of the first and second door panels 24, 26 includes hinge edges 24*a*, 26*a*, top transverse edges 24*b*, 26*b*, bottom transverse edges 24*c*, 26*c* and interior edges 24*d*, 26*d*.

Second hinge members 28 are secured to the hinge edges 24*a*, 26*a*. The second hinge members 28 are positioned and aligned to pivotally connect with the first hinge members 22 such that each of the door panels 24, 26 may be hinged to side walls 12, 13, respectively, and pivot from an open position exposing interior 18 to a closed position with the door panels 24, 26 covering the opening to interior 18.

Although not necessary to the teachings of the present invention, in a preferred embodiment each of the door panels 24, 26, on interior surfaces thereof, will be provided with mounting brackets 30 on which hardware, or the like, may be mounted. Also, first door member 24 is provided with latching hardware (shown generally at 31 to which a door handle or the like may be attached to latch the doors in a closed position). It will be appreciated that latching hardware and the like form no part of this invention per se and is shown solely for the purposes of illustrating the present invention in a preferred embodiment.

Figure 3:
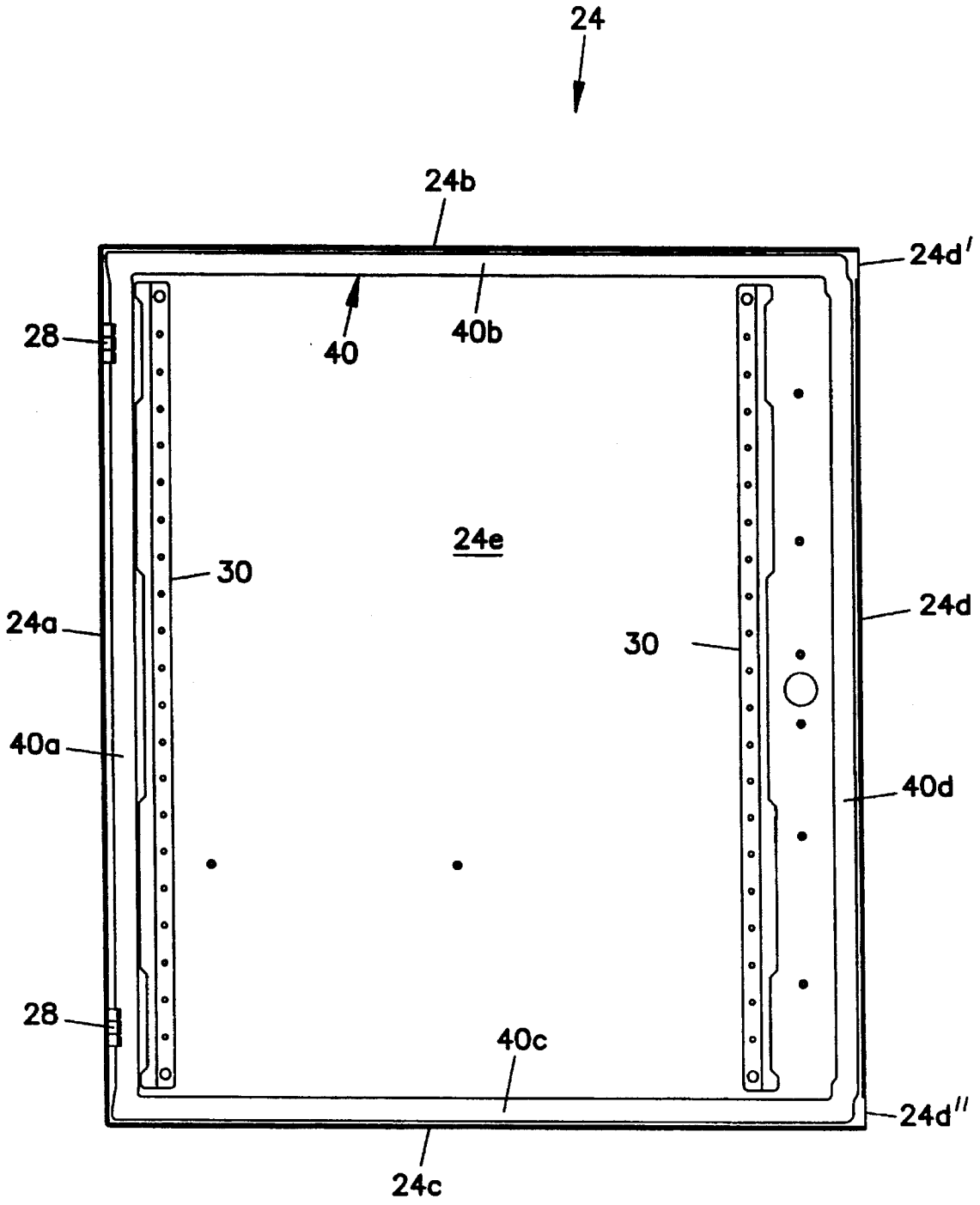
FIG. 3 is a plan view of an interior side of a second door panel for use in the present invention.
Figure 3A:
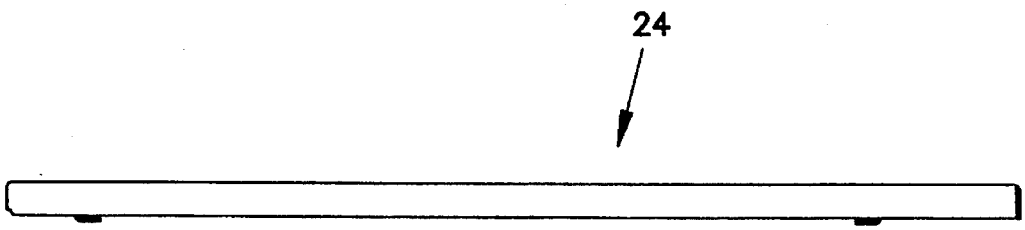
FIG. 3A is a plan view of a top edge (when viewed in FIG. 3) of the door panel of FIG. 3.
Figure 3B:
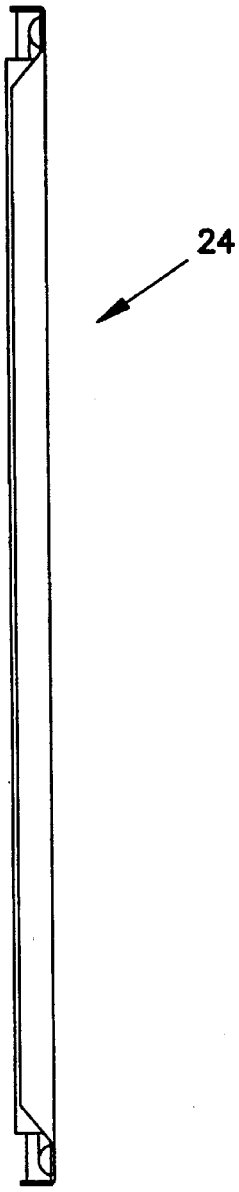
FIG. 3B is an elevation view of a right edge (when viewed in FIG. 3) of the door panel of FIG. 3.

With initial reference to FIGS. 3, 3*a* and 3*b*, first door panel 24 is separately shown. In the view of FIG. 3, mounting hardware 30 is not shown for purposes of clarity.

As shown in FIG. 3, the upper and lower transverse edges 24*b*, 24*c* and the hinge edge 24*a* comprise rearwardly projecting 90° flanges from the face 24*e* of the panel. The edges 24*a*, 24*b* and 24*c* are a continuous rearwardly projecting flange.

The free edge 24*d* is also a rearwardly projecting flange in the sheet metal of the panel 24. However, edge 24*d* does not extend the entire distance between edges 24*b*, 24*c*. Instead, free edge 24*d* is provided with cut out areas 24*d'*, 24*d"* adjacent edges 24*b* and 24*c*, respectively. The door panel 24 is sized such that upon mounting of its hinges 28 to hinges 22 on side wall 12, the door panel may be pivoted to a closed position with the interior face 24*e* opposing and abutting the edge 20 of cabinet 10. The edge 20 is completely received within the boundary of edges 24*a*, 24*b* and 24*c* and is free to pass between edges 24*b* and 24*d* through cut out 24*d'*. Further, edge 20 is free to pass between edges 24*c*, 24*d* through cut out 24*d"*.

The interior surface 24*e* has provided thereon a continuous bead 40 of resilient foam to provide a gasket completely surrounding the periphery of the inner surface 24*e*.

The gasket bead 40 includes a first length 40*a* which runs parallel to and adjacent edge 24*a*. The bead 40 further includes an upper length 40*b* which runs parallel to and closely adjacent to edge 24*b*. The bead 40 also includes a lower segment 40*c* which runs parallel to and closely spaced to edge 24*c*. Finally, the bead 40 includes a segment 40*d* which runs parallel to and closely adjacent to edge 24*d*. Unlike edges 24*a*, 24*b*, 24*c* and 24*d* (which are not continuous, but, instead are interrupted by cut-outs 24*d'* and 24*d"*), the segments 40*a*–40*d* are continuous to provide a continuous gasket bead 40.

Figure 15:
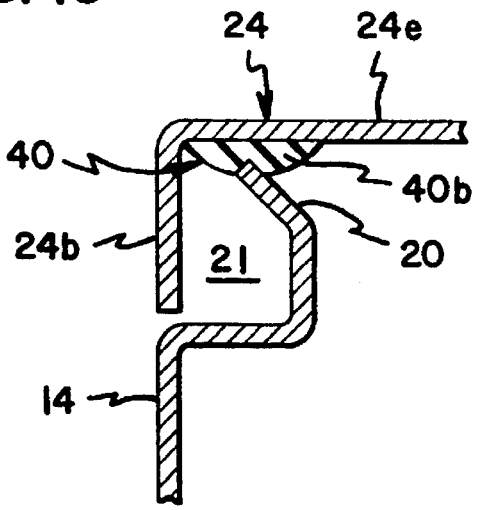
FIG. 15 is a view taken along line 15—15 of FIG. 10 with the addition of a sealing edge of a cabinet.
Figure 14:
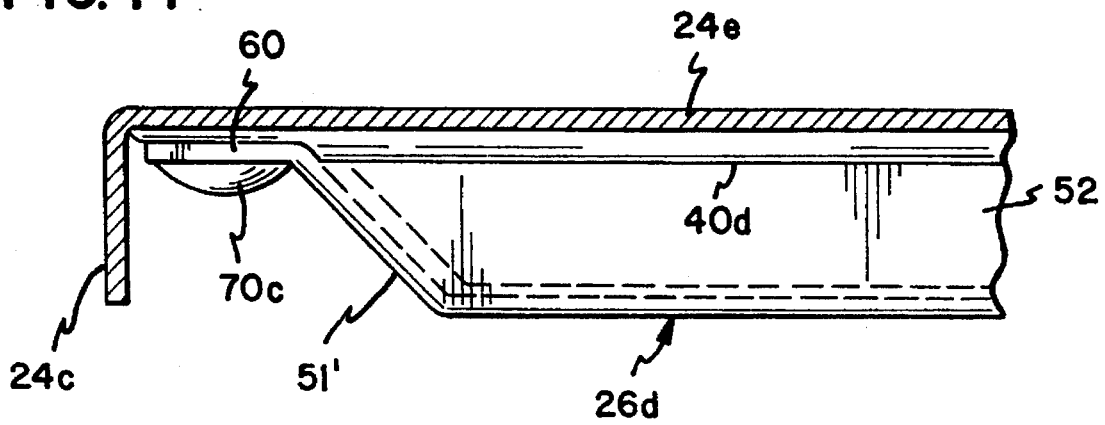
FIG. 14 is a view taken along line 14—14 of FIG. 10.

The gasket bead 40 is positioned for bead 40 to oppose and abut edge 20 when door panel 24 is pivoted to a closed position. Specifically, bead segments 40*a*, 40*b* and 40*c* oppose edge 20 with edge 20 urged into the resilient material of the bead segments 40*a*, 40*c* to deform the resilient material of the foam bead 40 and embed the edge 20 within the foam bead in sealing engagement as best shown in FIG. 15. Such sealing of edge 20 within the foam bead 40 provides a water tight and dust tight seal. Also, as shown in FIG. 15, the edge 20 defines a channel 21 such that any water which may enter between the doors and the cabinet are contained within the channel 21 and diverted away from the interior 18 of the cabinet 10.

Figure 2:
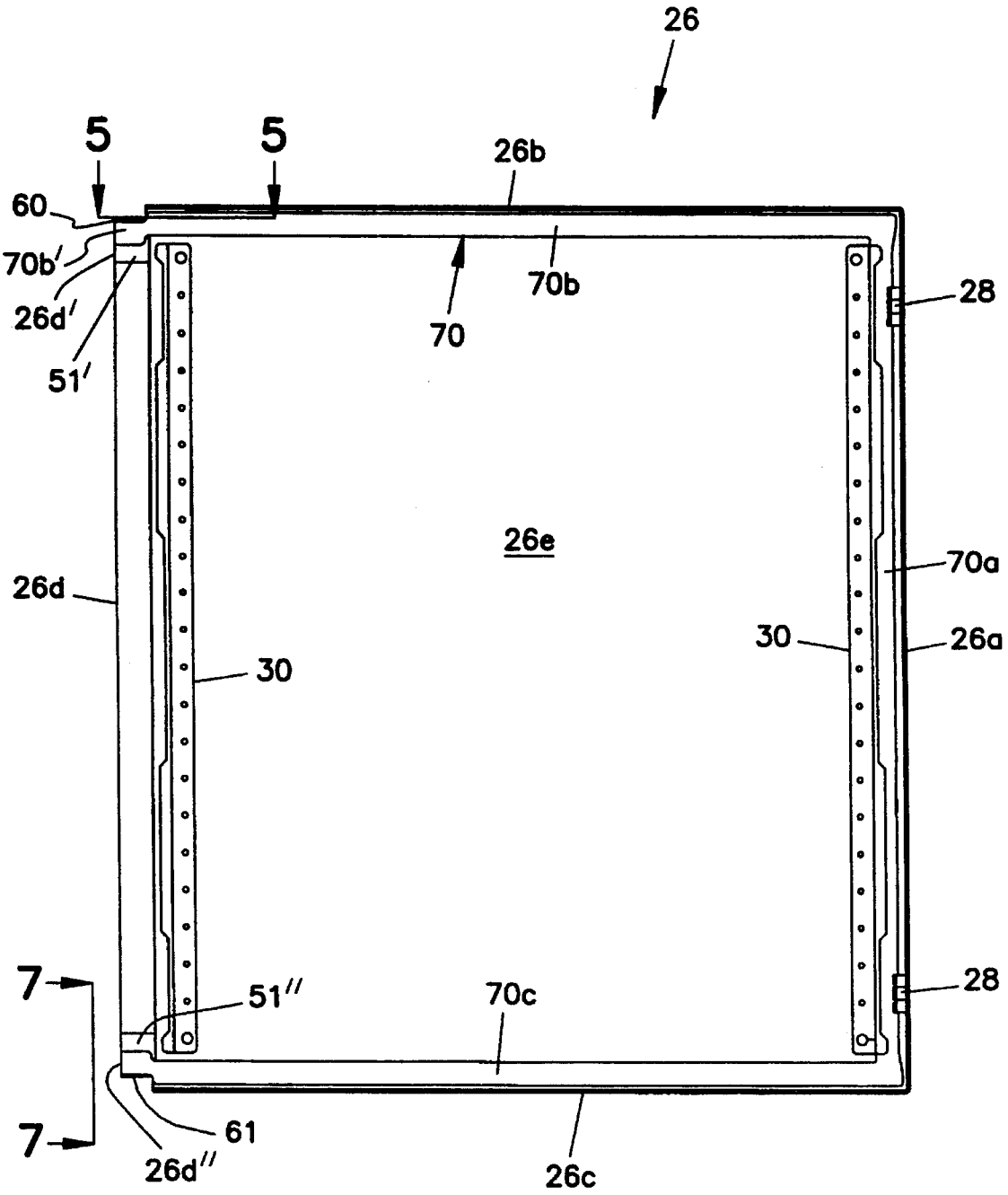
FIG. 2 is a plan view of an interior surface of a first door panel.
Figure 2A:
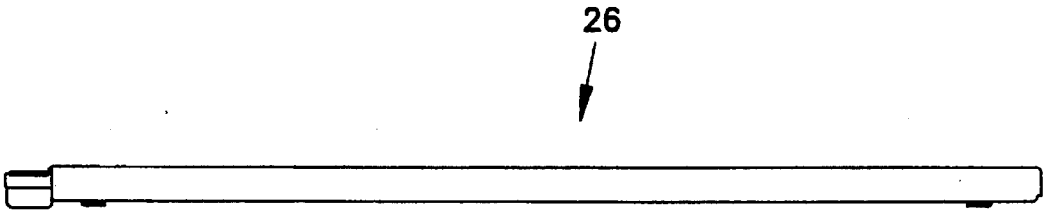
FIG. 2A is an elevation view of a top edge (as viewed in FIG. 2) of the door of FIG. 2.
Figure 2B:
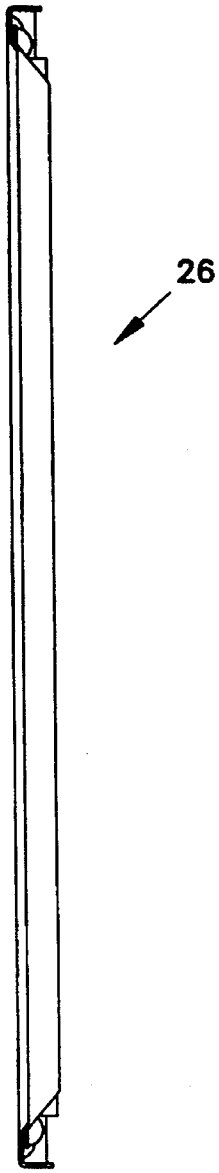
FIG. 2B is an elevation view of a left edge (when viewed in FIG. 2) of the door panel of FIG. 2.

With reference now to FIGS. 2, 2A and 2B, second door panel 26 will now be described. Like door panel 24, door panel 26 is one of the unitary construction of steel or the like. Edges 26*a*, 26*b*, and 26*c* are defined by bends formed from the face 26*e* of the door with the edges 26*a*–26*c* projecting rearwardly from the face 26*e* in a generally 90° orientation. Edges 26*a*–26*c* are continuous terminating only at edges 26*b* and 26*c*.

Edge 26*d* differs significantly from previously described edge 24*d*. Instead edge 26*d* is a generally U-shaped channel having a first leg 50 (FIG. 13) which projects rearwardly from face 26*e* at a 90° angle. Projecting parallel to surface 26*e* from edge 50 is a second leg 51. Finally, extending from leg 51 is a third leg 52 which is generally parallel to first leg 50. The legs 50–52 cooperate to define a chamber 54 which extends generally parallel to edge 26*d*.

The U-shaped channel of edge 26*d* does not extend the entire length between edges 26*b* and 26*c*. Instead, edge 26*d* is spaced from edge 26*b* by a cut-out area 26*d'*. Similarly, edge 26*d* is spaced from edge 26*c* by a second cut-out area 26*d"*. At the cut-out areas 26*d'*, 26*d"*, the edge 26*d* is provided with a flat area 60, 61, respectively, which is generally parallel to surface 26*e* but offset rearwardly from surface 26*e* to provide an area of thickness T (FIG. 5) sized to receive the thickness of surface 24*e* of door 24 and a compressed gasket bead 40 such that, upon closure of the doors (as will be described) the exterior surfaces of face 24*e* is parallel and coplanar with surface 26*e*. The flats 60, 61 are connected to the legs 51 by means of ramp surfaces 51', 51" so that interior 54 is completely out of communication with the rear of the panel 26 (see FIG. 13).

With the construction thus described, when door 26 is connected to the cabinet 11 in a closed position, the edge 20 opposing the door 26 is received within the boundary defined by edges 26*a*–26*b* and the edge 20 is clear to pass through the cut outs 26*d'*, 26*d"*.

The interior surface of the door panel 26 is provided with a gasket in the form of a bead 70 of foam material secured to the interior surface of the door 26. The gasket 70 includes a first segment 70*a*, a second segment 70*b*, a third segment 70*c*. Segments 70*a*–70*c* are parallel to and closely adjacent edges 26*a*–26*c*, respectively. Further, the segments 70*a*–70*c* provide a continuous connection between the segments without interruption (except there is no foam along edge 26*d*.)

Figure 4:
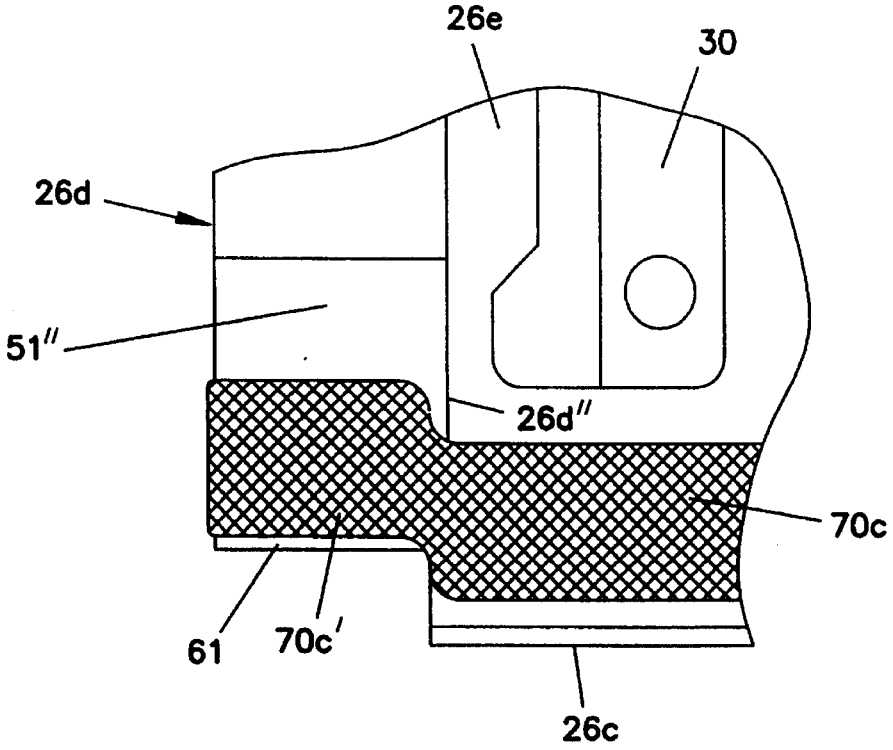
FIG. 4 is an enlarged plan view of a lower left hand corner of the interior surface of the panel of FIG. 2 with the upper left hand corner being a mirror image thereof.
Figure 5:
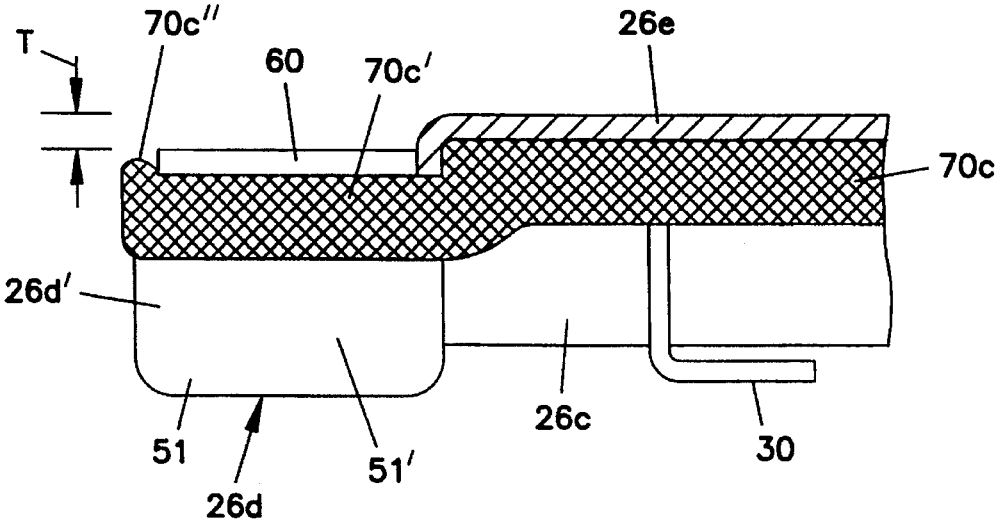
FIG. 5 is a view taken along line 5—5 of FIG. 2.
Figure 6:
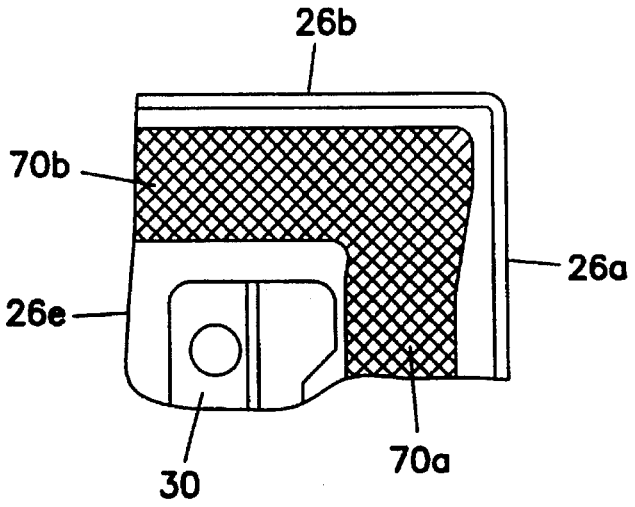
FIG. 6 is an enlarged plan view of the upper right hand corner of the view of FIG. 2 with the lower right hand corner of the view of FIG. 2 being a mirror image thereof.
Figure 7:
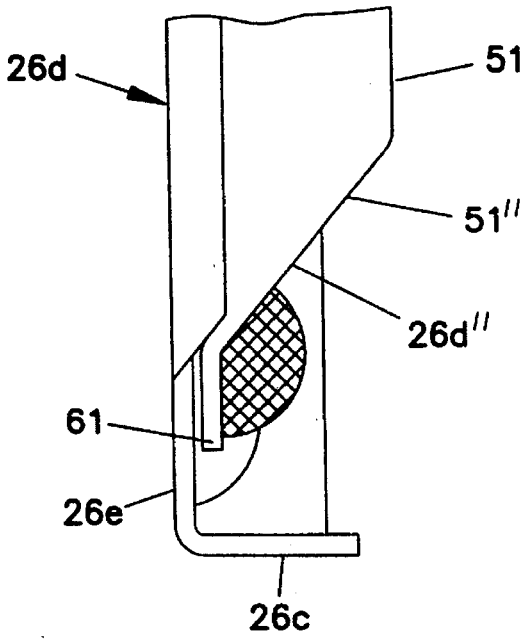
FIG. 7 is a view taken along line 7—7 in FIG. 2.
Figure 8:
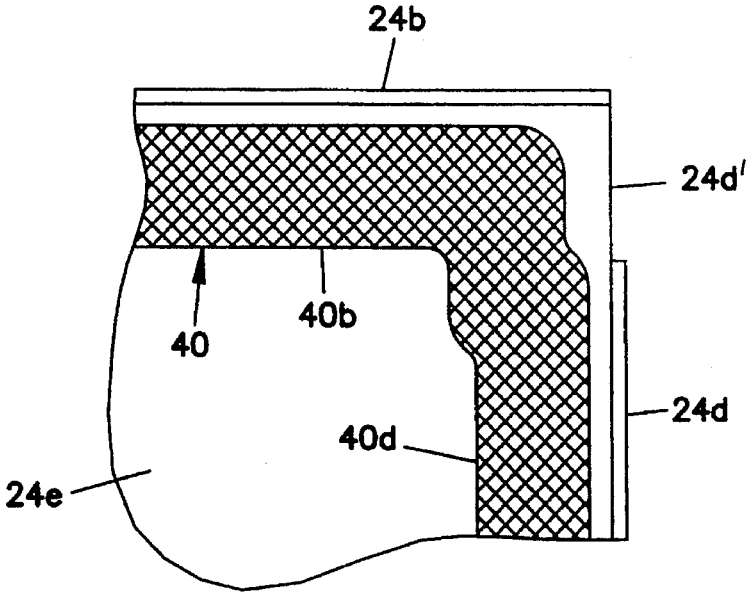
FIG. 8 is an enlarged plan view of the upper right hand corner of the door panel of FIG. 3 with the lower right hand corner being a mirror image thereof.
Figure 9:
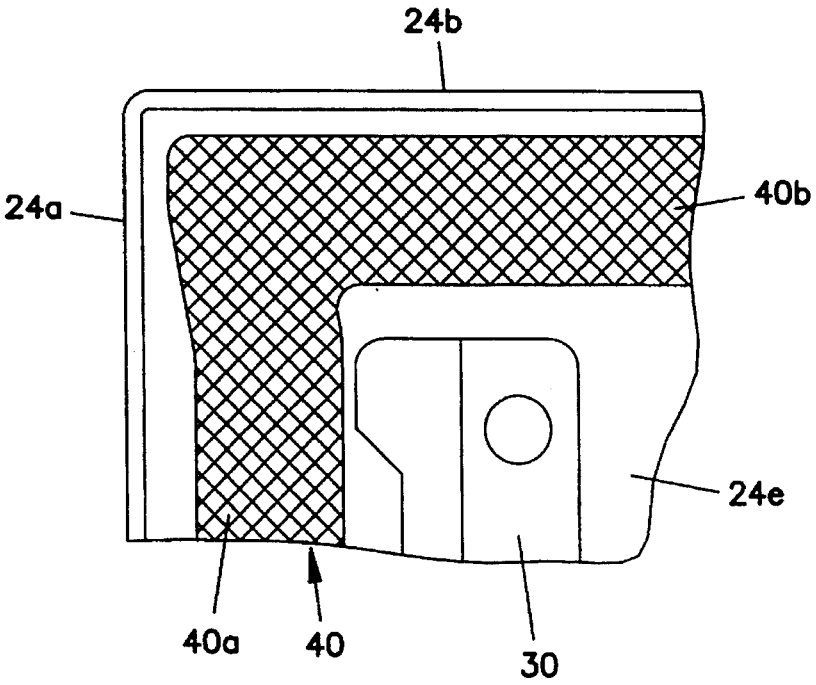
FIG. 9 is an enlarged plan view of the upper left hand corner of the view of FIG. 3 with the lower left hand corner being a mirror image thereof.
Figure 10:
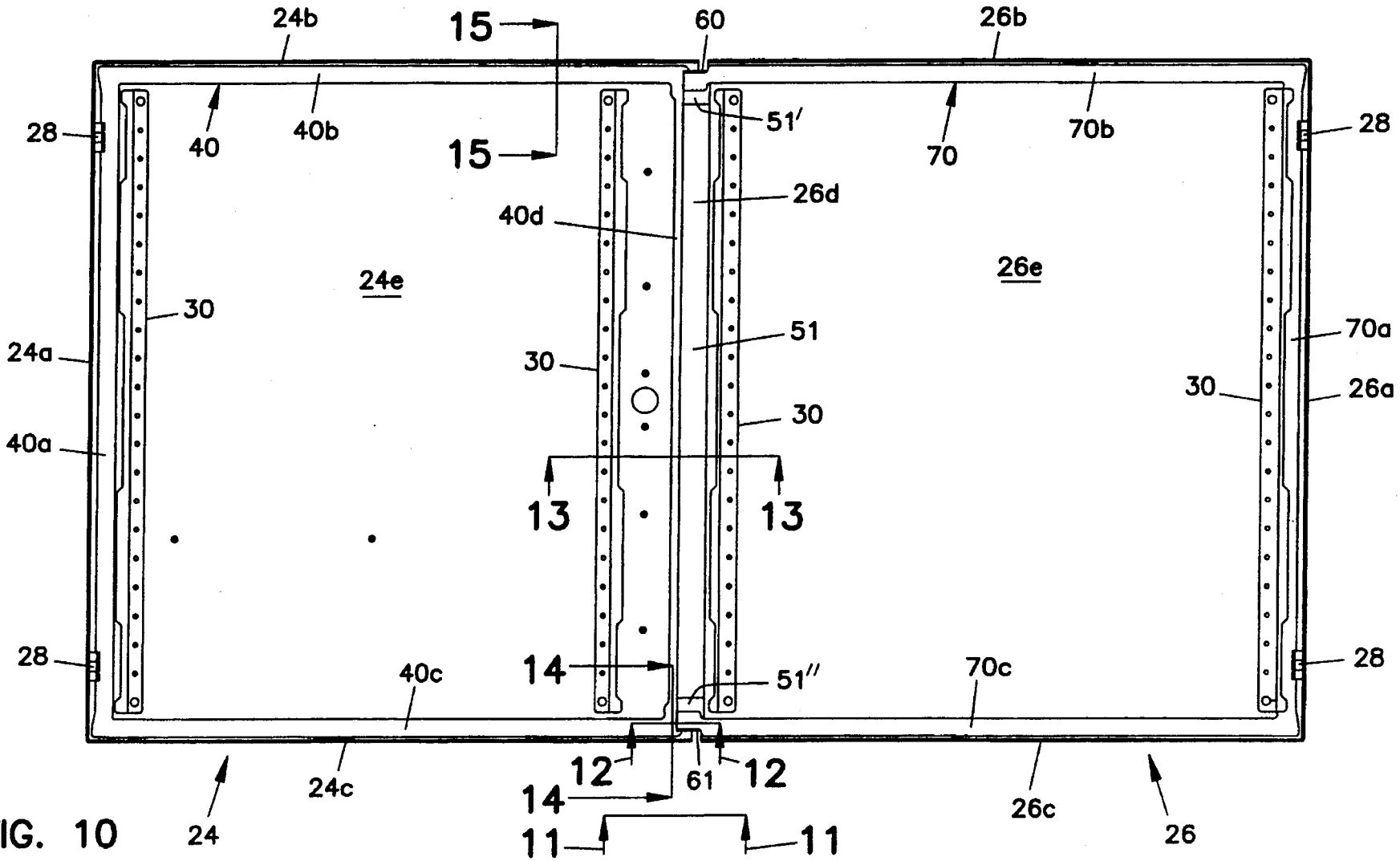
FIG. 10 is a plan view of interior sides of two overlapping door panels of FIGS. 2 and 3 when pivoted to a closed position.
Figure 11:
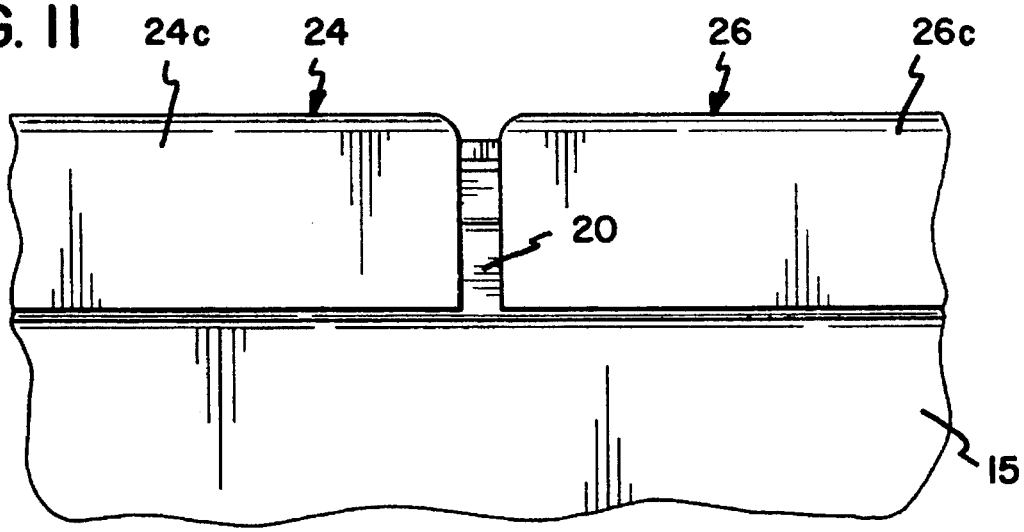
FIG. 11 is a side elevation view of the top edge of the overlapping area of FIG. 10 with the addition of a sealing edge of a cabinet.

Segments 70*b*, 70*c* are further provided extending onto the flats 60, 61 as shown by portion 70*c'* in FIGS. 4 and 5 residing on flat 61 and portion 70*b'* (FIG. 2) on flat 60. Portion 70*c'*, 70*b'* are sized to extend beyond and protrude over flat 61 as shown at location 70*c"* in FIG. 5.

With the construction thus described, when both doors are positioned to a closed position, door 26 is first closed for bead segments 70*a*–70*c* to engage edge 20 in sealing engagement. Door 24 is next closed for bead segments 40*a*–40*c* to engage edge 20 in sealing engagement.

Figure 12:
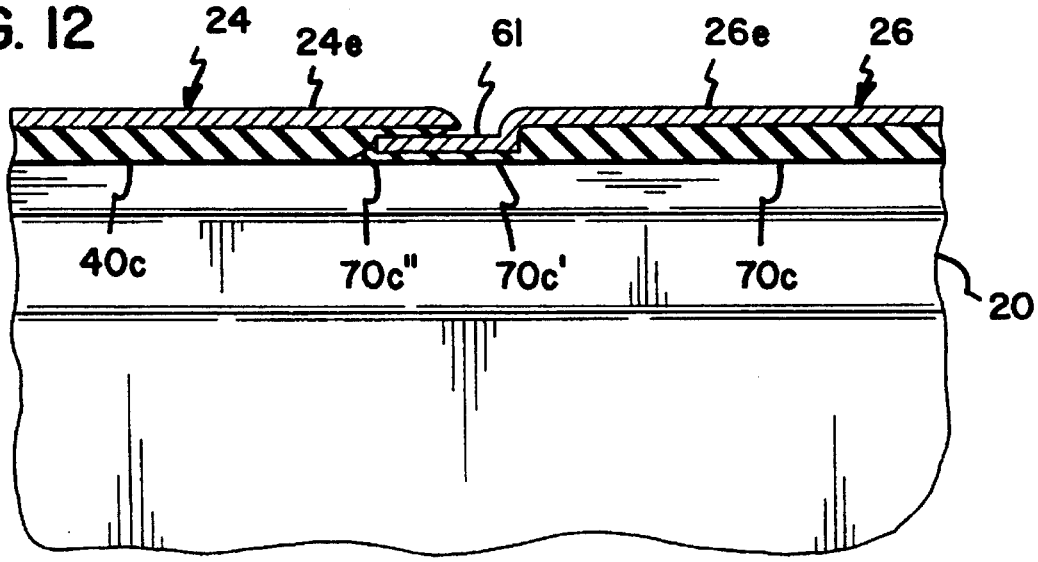
FIG. 12 is a view taken along line 12—12 of FIG. 10 with the addition of a sealing edge of a cabinet.
Figure 13:
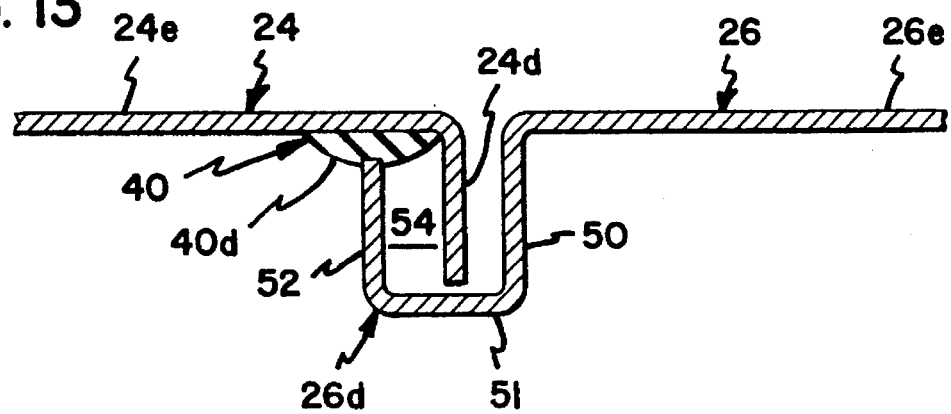
FIG. 13 is a view taken along line 13—13 of FIG. 10 with the addition of a sealing edge of a cabinet.

With the doors thus closed, edge 24*d* is received within channel 54 as shown in FIG. 13. Leg segment 52 is received against bead 40*d* in sealing engagement. Further, the edge 20 urges against bead segments 70*c'* and 70*c"* as well as aligned bead segment 40*c* to urge the bead segment 70*c"* into sealing engagement with bead segment 40*c* (see, FIG. 12). Accordingly, a continuous sealed and compressed bead of the foam material is provided surrounding the entire periphery of the opening to interior 18 with the entire length of edge 20 sealed against resilient foam of the door panels 24, 26. Further, the entire vertical seam between the door panels 24, 26 is sealed by reason of length 52 sealed within bead 40*d* and the overlapping sealing with surface 61 sealing against bead 40*c* (as shown in FIG. 12) and with bead segment 70*c"* sealing against bead segment 40*c*. As a result, all seams of a door are completely sealed against water and dust. Further, the chamber 54 including angled surfaces 51', 51" deflect water from the seal between bead 40*d* and edge 42 to permit the water to be directed away from the doors.

With the foregoing description, a door arrangement which is completely sealed against dust and water intrusion has been provided. The sealing arrangement permits a double door without the need for an interior support bar within the cabinet 10. Further, the arrangement provides for complete sealing around seal 20 and the seam between the doors without the need for providing a gasket or sealing material on both sides of any one door.

From the foregoing detailed description of the present invention, it has been shown how the invention has been attained in the preferred manner. However, modifications and equivalents of the disclosed concepts such as those which readily occur to one skilled in the art are intended to be included within the scope of the claims are appended hereto.

What is claimed is:

1. An overlapping door for a cabinet having an outwardly protruding edge (20) defining a door opening, said cabinet comprising: cabinet comprising:

a first door panel (24) having a first hinged edge (24*a*) pivotally secured to said cabinet on a first side thereof;

a second door panel (26) having a second hinged edge (26*a*) pivotally secured to said cabinet on a second side thereof;

each of said first and second door panels (24, 26) pivotable at said first and second hinged edges (24*a*, 26*a*) for said door panels (24, 26) to pivot about said hinged edges between an open position exposing said opening and a closed position covering said opening;

said first and second door panels (24, 26) each having first and second spaced apart transverse edges (24*b*, 24*c*; 25*b*, 26*c*) extending from said hinged edges (24*a*, 26*a*) and each of said door panels (24, 26) having free edges (24*d*, 26*d*) generally parallel to said hinged edges and (24*a*, 26*a*) and joining said first and second transverse edges (24*b*, 24*c*; 26*b*, 26*c*);

said door panel (24, 26) sized for said door panels (24, 26) to overlap in an overlap area at said free edges (24*d*, 26*d*) with an interior surface of said first panel (24) opposing an exterior surface of said second door panel (26) in said overlap area;

each of said door panels (24, 26) having a sealing gasket (40, 70) deposited on an interior surface thereof and including a gasket (40*b*, 40*c*; 70*b*, 70*c*) portion formed adjacent said transverse edges (24*b*, 24*c*; 26*b*, 26 *c*), said gaskets (40, 70) at said hinged edges (24, 26) and said transverse edges (24*b*, 24*c*; 26*b*, 26*c*) positioned for said gaskets to sealingly engage said outwardly protruding edge (20) of said cabinet when said doors (24, 26) are in said closed position;

said gasket portion (70*c*) layer on said second door panel (26) sized to protrude beyond said free edge (26*d*) of said second door panel (26) and be in alignment with said gasket portion (40*c*) layer of said first door panel (24) for said gasket portion (70) layer of said second door panel (26) to protrude beyond and engage said gasket portion (40*c*) layer of said first second door panel (24) in sealing engagement upon closure of said doors (24, 26);

said free edge (26*d*) of said second door panel (26) including an outwardly protruding edge (52), said gasket (40) of said first door panel (24) including a segment (40*d*) on an interior surface of said first panel (24) and extending parallel to said free edge (24*d*) of said first door panel (24), said outwardly protruding edge (52) of said second door panel (26) and said gasket segment (40*d*) of said first door panel (24) positioned for said outwardly protruding edge (52) to engage said gasket segment (40*d*) in sealing engagement upon closure of said doors (24, 26).

2. A cabinet according to claim 1 wherein said free edges are sized to be in spaced relation to said transverse edges of each of said door panels for said protruding edge of said cabinet to freely pass between said door panels when said doors are in said closed position.

3. A cabinet according to claim 1 wherein said free edge of first door panel includes a rearwardly projecting flange, said free edge of said second door panel including a channel defining member sized to receive said flange of said first door panel.

4. A cabinet according to claim 3 wherein said channel includes upper and lower flat areas with said gasket of said second door panel deposited on said flat area and protruding beyond said flat area for said protruding portion of said gasket to engage said gasket of said first door panel in sealing engagement upon closure of said doors.

* * * * *

UNITED STATES PATENT AND TRADEMARK OFFICE
CERTIFICATE OF CORRECTION

PATENT NO. : 5,465,528

DATED : November 14, 1995

INVENTOR(S) : Craig E. Schinzel, et al.

It is certified that error appears in the above-identified patent and that said Letters Patent is hereby corrected as shown below:

Column 5, line 41, claim 1, delete "cabinet comprising" after the word "comprising:";

Column 6, line 4, claim 1, "panel" should read --panels--; and

Column 6, line 12, claim 1, "gasket (40b,40c; 70b,70c) portion" should read --gasket portion (40b,40c; 70b,70c)--.

Signed and Sealed this

Twenty-sixth Day of March, 1996

Bruce Lehman

*Attest:*

BRUCE LEHMAN

*Attesting Officer*

*Commissioner of Patents and Trademarks*